United States Patent [19]

Michelson

[11] 4,291,740

[45] Sep. 29, 1981

[54] APPARATUS AND METHOD FOR HEATLESS PRODUCTION OF HOLLOW ITEMS, FOR INSTANCE, FOUNDRY SHELL CORES

[76] Inventor: Anatol Michelson, 3235 Pine Valley Dr., Sarasota, Fla. 33579

[21] Appl. No.: 154,006

[22] Filed: May 28, 1980

[51] Int. Cl.[3] ..... B22C 13/08

[52] U.S. Cl. ..... 164/7.1; 164/16; 164/161; 164/165

[58] Field of Search ..... 164/7, 12, 16, 17, 161–163, 164/165

[56] References Cited

U.S. PATENT DOCUMENTS 4,232,726 11/1980 Michelson ..... 164/16 X

FOREIGN PATENT DOCUMENTS 48-27177 8/1973 Japan ..... 164/16

48-30210 9/1973 Japan ..... 164/16

*Primary Examiner*—Robert D. Baldwin

[57] ABSTRACT

Disclosed is an apparatus and a method for heatless production of hollow items, such as foundry shell cores, from the mixture of granular mineral and synthetic binder, as provided by the principal process described in the patent application Ser. No. 22,170, now U.S. Pat. No. 4,232,726 issued Nov. 11, 1980.

Two permeable-to-gas patterns form an inner cavity of desirable configuration and are enclosed by non-permeable halves of the pattern box, forming an outer cavity or flow space. The pattern box is mounted on two plates of the rotatable cage assembly, selectively positionable in at least three positions: charge, discharge, and transfer. Above the pattern box are pivotally mounted material supply means, sealing means, and a trimmer. Below the pattern box is a receiver of an air-less conveyor for recirculation of the discharged unhardened material. The pattern box is connected to two manifolds: one for consecutive supply of catalyst gas and the compressed air, another for exhaust and venting. After material has been blown with the help of compressed air from the material supply means into the pattern inner cavity, it is sealed and the air is flushed out of the system by compressed catalyst gas introduced into the pattern box for about one second. Said gas then penetrates to desirable depth into material's outer layer starting polymerization and curing of its binder. After a few seconds, unsealed pattern box assembly is turned upside down and compressed air is blown into the pattern box, dislodging unhardened portion of the material out of the inside of the produced shell-like product. Consequently, the pattern box is opened and the product is transferred from the apparatus to a suitable place outside the machine. The production process has nine basic steps, and the cycle of the apparatus comprises twenty-four (24) operations completely mechanized and performed within approximately thirty seconds.

21 Claims, 13 Drawing Figures

APPARATUS AND METHOD FOR HEATLESS PRODUCTION OF HOLLOW ITEMS, FOR INSTANCE, FOUNDRY SHELL CORES

OBJECTS OF THE INVENTION

One object of this invention is to provide the physical means for the execution of the entirely new process, described in my U.S. Pat. No. 4,232,726, which is aimed at heatless production of hollow mineral items, thus saving a very essential amount of energy, consumed now by the equipment that performs the existing thermal (croning) process.

Another object of the invention is to increase drastically (three to four times) the productivity rate of machines, and consequently of operators.

Yet another object of this invention is to convert production of solid cores made by a so-called "cold box process" to the production of hollow (shell) cores, thus reducing consumption of materials, on the average, three times, which in turn means essential reduction in production cost. Still another object of this invention is to improve working conditions, by eliminating excessive heat and fumes at the operator's working place.

Other objects and advantages of the invention will become apparent from the following description.

SUMMARY OF THE INVENTION

This disclosure describes an apparatus and the practical, mass-production method of manufacturing heatlessly, at high speed, hollow mineral items, for instance, foundry shell cores, as provided to a great extent by the principal process, patented under U.S. Pat. No. 4,232,726, elaborated and supplemented in this disclosure.

The apparatus has a novel pattern box, consisting of two halves with a vertical parting plane, each having five main elements: gas-permeable pattern, impermeable enclosure with two ports, the flow space between pattern and enclosure, investment conduit, and the ejection plate with a number of ejection pins. The pattern box is mounted on two vertical plates, one of which may be stationary and the other can reciprocate, making a closing stroke equal to slightly more than maximum product width, and making two consecutive opening strokes, each of which is equal to half of the closing stroke. Both plates are mounted on horizontal rods of a turnable pattern box assembly which, during different phases of the cycle, turns to three positions: investment aperture up, toward blow head; investment aperture down, toward discharge hopper; and investment aperture to side, toward product transfer mechanism. The conventional blow head has a unique permanent blow plate featuring a number of orifices of less than one-inch diameter, placed within a circle smaller than the investment aperture. The sealing means, serving to close investment aperture during gassing, is pivotally mounted on the blow head. The unhardened portion of material, removed from the inside of produced shell, is returned into the receiving hopper by mechanical means. The removal of unhardened material from the shell is facilitated by the compressed air introduced into flow space. Prior to gassing the material, the flow space is rinsed by the catalyst gas, which then is released to the atmosphere through any conventional purifying device. All mechanisms located above the pattern box are pivotally mounted on the base in order to provide instant access to the pattern box from above by swinging said mechanisms aside, whenever a change of box is needed.

The method of operation includes nine basic and four peripheral steps.

The basic steps are comprised of:

(1) Orienting a pattern box into a position for reception of a granular mineral mixture, which step comprises closing two pattern box halves together while securing retraction of ejection pins and opening a pattern box flow space to the venting through a first port while closing a second port;

(2) Densifyingly charging binder coated granular mineral by means of compressed air into the pattern box through its investment aperture;

(3) Sealing the investment aperture;

(4) Flushing air out of the flow space by introducing catalyst gas through the second port in the pattern box while simultaneously keeping the first port open to the atmosphere through a scrubber means.

(5) Separating the flow space from the atmosphere by closing the first port, thereby forcing pressurized catalyst gas to commence penetration through permeable-to-gas pattern walls into cavity (where air between granules is at atmospheric pressure) thereby causing polymerization of the binder and hardening of the outer layer of the granular minerals;

(6) Terminating admittance of catalyst gas into the flow space and commencing the curing of the hardened mineral layer while unsealing the investment aperture and opening communication of the flow space to the exhaust;

(7) Trimming the hardened excess material from the investment aperture of the pattern box and that of the formed hollow item;

(8) Discharging the unhardened material from the inside of the hardened outer layer by means of gravity (inverting pattern box assembly) and compressed air, thereby leaving within the pattern the hollow item only; and (9) Opening the patten box and removing the hollow item by means of ejection pins and transfer means.

The peripheral steps are preferably executed simultaneously with the basic steps outlined above and therefore do not affect the duration of a cycle.

These steps are:

(1) Mixing the granular mineral with the synthetic binder, e.g., isocure resins, in a conventional continuous mixer;

(2) Transferring the binder-coated material from a mixer to a feed hopper;

(3) Screening and transferring discharged unhardened material back to feed hopper for recirculation; and (4) Periodically cleaning and lubricating the pattern work surfaces.

BRIEF DESCRIPTION OF THE DRAWINGS

For a fuller understanding of the nature and objects of the invention, reference should be made to the following drawings in which.

Similar references are made to similar parts throughout the drawings.

DETAILED DESCRIPTION OF THE PREFERRED APPARATUS AND METHOD

Figure 1:
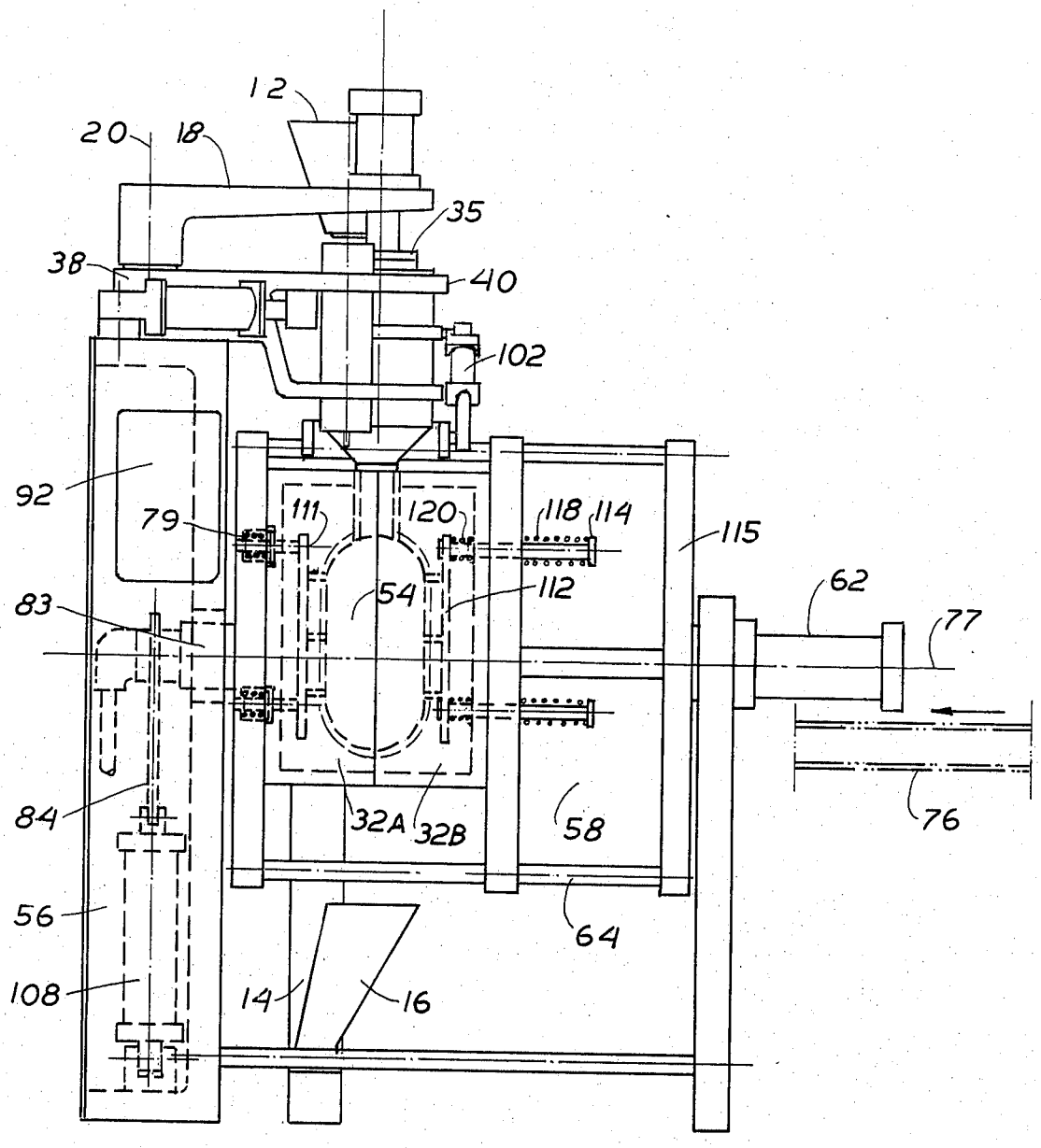
FIG. 1 is a front elevation view of the preferred apparatus.

The inventive apparatus for manufacturing of foundry shell cores and other similar hollow items heatlessly is shown in elevation view in FIG. 1.

The feed hooper 12 is charged with a binder coated granular material, (not shown) such as sand, by a conventional mixer apparatus (not shown). The mechanical elevator 14 returns unhardened sand from the receiving hopper 16 to the feed hopper 12 so that the unhardened sand can be reused. Since the sand is coated with a resin which in turn comprises a solvent that should not be exposed to prolonged air draft (since such exposure would lower the solvent content of the resin and therefore adversely affect the binding quality of the resin), the elevator 14 is airless.

The feed hopper 12 is carried by a pivotally mounted plate 18. The plate 18 is held against inadvertent rotation about its pivotal axis 20 by any conventional means for instance, a pin (not shown).

The pivotal mounting of the hopper-carrying plate 18 is an important structural feature of this invention. Although the plate 18 remains stationary during the process which is to be described hereinafter in detail, it is desirable to nevertheless pivotally mount the plate 18 to reduce the amount of down time of the apparatus when pattern boxes are being changed. Since the pattern box 32, hereinafter described, is preferably disposed beneath the feed hopper 12 and hence, beneath the plate 18, conventional techniques for changing pattern boxes include approaching the pattern box, to be removed, from floor level, cradling the same in ropes or chains, and lifting the box carrying cradle assembly with a fork lift truck. Of course, installing a new pattern box involved essentially the reverse of this procedure. Although most shops have an overhead crane, the overhead removal and installation of pattern boxes with conventional hopper mounting is an extremely time-consuming operation, if not impossible at all. By pivotally mounting the plate 18, the pattern boxes 32 may be provided with a hook means 34 so that an overhead crane can be very easily used to remove such a box when the plate 18 is swung out of the way.

The plate 18 also carries a hydraulic or pneumatic cylinder means 36. The function of the cylinder 36, and indeed the function of the feed hopper 12, as well, is best understood by referring now to a second pivotally mounted plate, generally designated 38, that is disposed downwardly of the first plate 18, and which also pivots about the same axis 20, defined by shaft 28. The lower plate 38 has an integrally formed upper arm 40 and lower arm 42 for carrying, respectively, the upper and lower portions of a blow head means 44 and a cutting or trimming means 46. Unlike the normally stationary upper plate 18, the lower plate 38 is moved about its pivotal axis 20 during every cycle of the inventive method as will be described. The plate 38 can be easily swung aside when changing a pattern box by disengaging it from the cylinder means 48.

Figure 3:
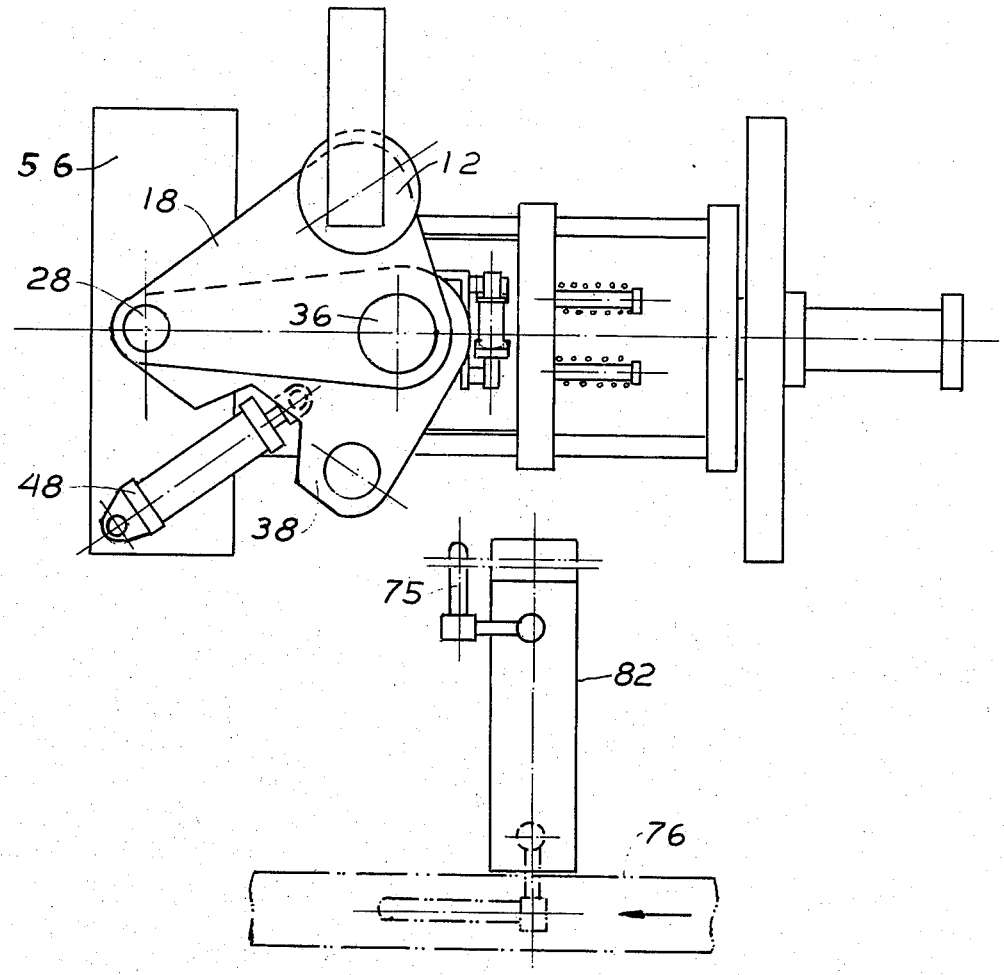
FIG. 3 is a plan view of the preferred apparatus.

Reference should now be made to FIGS. 1 and 3, which shows the relative dispositioning of the upper plate 18 and lower plate 38. The pivotal axis 20 is seen as common to both plates.

Most importantly, it will be observed that when the lower plate 38 is pivotally displaced by cylinder means 48 (also shown in FIG. 3), the longitudinal axis 45 of the blow head 44 is enterable into axial alignment with the longitudinal axis of the feed hopper 12. This concentric alignment of the feed hopper 12 and the blow head 44 permits charging of the blow head 44 with the premixed binder coated granular material from the feed hopper 12. Reactivation of the cylinder means 48 then pivots the lower plate 38 until the blow head 44 has its longitudinal axis 45 in axial alignment with the longitudinal axis of the hydraulic cylinder 36 that, like the feed hopper 12, is carried by the upper plate 18. At this point, it is appropriate to note that both the blow head 44 and its lower plate companion, the trimming means 46, are disposed in at least a partially surrounded relation by two springs collectively designated 50, that respectively urge the lower plate companion members 44 and 46 upwardly, i.e., toward the upper plate. This upward bias serves to hold most of the time the blow head 44 and the trimming means 46 away from the pattern box assembly, hereinafter described.

When the lower plate 38 has been pivoted about the axis 20 by cylinder means 48 to bring blow head 44 into axial or concentric alignment with the hydraulic cylinder 36 carried by the upper plate 18, activation of the hydraulic cylinder 36 effects compression of the springs 50 and hence downward movement of the blow head 44. The downward movement of the blow head 44 continues until the blow head 44 sealingly mates with an investment aperture 52 that is formed in the pattern box 32, best seen in FIGS. 1 and 4. Compressed air introduced in cup 35 forces the material out from the blow head 44 into the inner cavity 54 of the pattern box 32. In like manner, the hydraulic cylinder 36 also effects compression of the springs 50 associated with the trimming means 46 and hence downward travel of the trimming means 46 into the investment aperture 52, when such movement, of course, is required in the process, will be set forth hereinafter. The blow head means 44 is provided with a sealing gasket to prevent particles of granular material from escaping into working space around apparatus.

Summarizing the capabilities of the inventive apparatus as thus far disclosed, it has been shown that the blow head 44 can be moved into registration with the feed hopper 12 for charging and into registration with the hydraulic cylinder 36 for discharging. The trimming means 46 can also be moved into and out of registration with the hydraulic cylinder 36. Further, when either the blow head 44 or the trimming means 46 is in registration with the upwardly disposed normally stationary hydraulic cylinder 36, at such time the blow head 44 or trimming means 46 will be in registration with the investment aperture 52 formed in the pattern box 32. Thus, both the blow head 44 and the trimming means 46 can be displaced downwardly into registration with the investment aperture 52 by the hydraulic cylinder 36, at the appropriate times in the inventive method as hereafter disclosed.

Continuing now with the disclosure of the inventive apparatus, attention again is directed to FIG. 1, which depicts the apparatus in front elevation. The general structural features of the apparatus that should now be noted include the frame elements 56, that collectively support the apparatus, and the cage assembly 58, that serves the function of correctly orienting the separate halves of the pattern box 32 relative to one another and relative to the other parts of the apparatus. FIG. 1 depicts the position of the inventive apparatus when the inner cavity 54 of the pattern box 32 is being charged with granular minerals forced from the blow head 44 through a blow plate 59. The parting plane for the pattern box halves is designated 60. Left half 32A of the pattern box 32 is stationary at all times. The other half 32B of the box 32 travels linearly responsive to activation of a hydraulic drive means 62.

The rods 64 act to maintain precise transverse alignment of the box halves 32A, 32B, and collectively, define a portion of the pivotal cage assembly 58, hereinafter described.

The pattern box 32 has non-permeable-to-gas outer walls 66 and permeable-to-gas pattern 68, defining flow space 70.

The outer walls 66 preferably are formed of sheet metal, whereas, the pattern halves 68 may be formed entirely of permeable-to-gas materials such as sintered powder metal, or from solid materials having chessboard-like staggered inserts of permeable material. The latter embodiment often is less expensive and easier to manufacture than the former, and good results are obtainable if the distance between the staggered permeable inserts is somewhat smaller than insert diameter.

Figure 4:
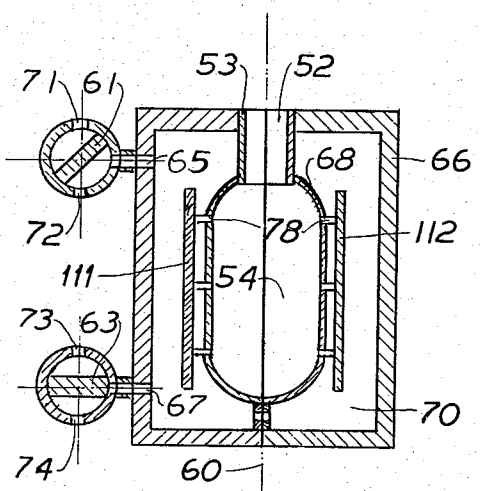
FIG. 4 is a schematic of the first basic step in the inventive method.

The binder coated granular material that is employed in the course of the inventive method is densifyingly charged into the pattern cavity 54 through investment aperture 52 which is in fluid communication with the pattern cavity 54 through non-permeable-to-gas sleeve 53. The pattern box 32 comprises two half boxes 32A and 32B, the juxtaposition of which defines the pattern box 32. Each half of the pattern box has a preferably semi-circular opening to which is attached a non-permeable-to-gas half of sleeve 53 so that investment aperture 52 is defined when the pattern box halves 32A and 32B are placed in juxtaposition as shown in FIGS. 1 and 4.

The outer walls 66 are provided with a pair of ports 65, 67 that open into the flow space 70. The upper port, designated 65, is in fluid communication with a manifold valve means, generally designated 61. One position of the valve means 61 simply closes the port, whereas the other position 71 brings the flow space 70 into fluid communication with an exhaust fan and scrubber means (not shown) and the third position 72 with just a scrubber or atmosphere. The other port, generally designated 67, communicates with a manifold valve means 63 having also three positions, one of which is closed, the other 73 brings the flow space 70 into fluid communication with a source of compressed air, and the third 74, with the source of catalyst gas.

Spacing members 69 serve to at least partially support the respective halves of the pattern 68, and ejection pins 78 serve to eject the formed hollow items from the pattern box 32 when the process is substantially completed. The hollow items produced by the novel apparatus are ejected from the pattern 68 in the following manner. The pattern box is opened in two distinct stages. The movable pattern box half 32B is displaced away from the non-movable pattern box half 32A at a distance at least slightly greater than one half of the width of the formed hollow item. At the very beginning of this movement, the ejection pins 78, under force of springs 79, will then expel or eject the item from the non-movable pattern box half 32A. Upon completion of the first stage of pattern box half 32B stroke, the rod 75 of the transfer mechanism, designated 82 as a whole and described in detail in the inventor's application Ser. No. 974,102, now U.S. Pat. No. 4,204,569, is then inserted into the hollow item through investment aperture 52 and the second stage of the box opening process then proceeds. The movable half 32B again displaces away from the non-movable half 32A a distance the same as in previous movement, and the beginning of this second displacement is accompanied by the ejection of the hollow item from the movable half 32B by its ejection pins 78. This leaves the hollow item resting on the transfer mechanism's rod 75, which carries the formed item to the conveyor belt means 76 so that the inventive apparatus can repeat its cycle again and again, automatically.

Figure 2:
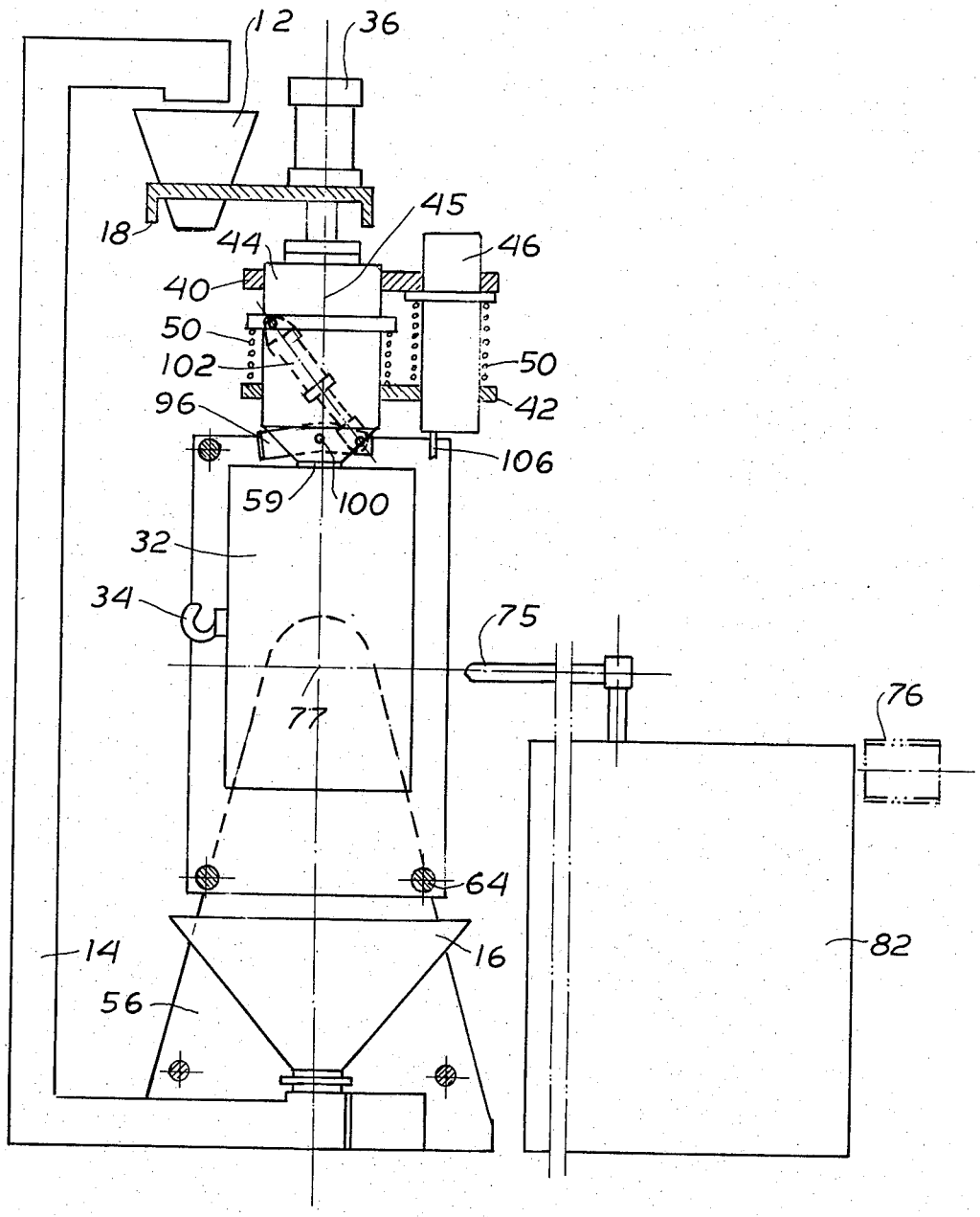
FIG. 2 is a side elevation view of the preferred apparatus.

The pattern box 32 may assume any one of three positions about an axis of rotation 77 best seen in FIGS. 1 and 2. The first, or upright, position is shown in FIGS. 1 and 2, and will be referred to hereinafter as the charging position. The second position assumable by the pattern box 32 is reached by rotating the pattern box 32 about its axis of rotation 77 by 180° and will be referred to hereafter as the discharging position. The third position lies halfway between the first two described positions and will be referred to as the transfer position. The preferred mechanism for accomplishing the rotation of the pattern box 32 about its axis 77 comprises either hydraulic rotary actuator or hydraulic cylinder 82 interconnected to the shaft 83 of cage assembly 58 by a rack and pinion pair 84. The cylinder 82 with rack/pinion pair 84 are best seen in FIG. 1.

It will now be appreciated that pattern box 32 can be changed, by the use of an overhead crane as earlier described, when the pattern box 32 is in its transfer position, if a hook means 34 such as that shown in FIG. 2 and mentioned earlier, is provided on the wall of the pattern box 32 that is facing upwardly when the pattern box 32 is in its transfer position.

All of the above-described movements of the inventive apparatus are controlled through control panel means 92, shown in FIG. 1.

Having now described the apparatus in detail, the respective roles played by the just described parts of the apparatus in carrying out the inventive method should be apparent.

Nevertheless, a detailed description of the preferred machine operations will now be set forth.

DETAILED DESCRIPTION OF THE APPARATUS OPERATIONS

The specific machine operations undertaken by the preferred apparatus in carrying out the novel method of operations can be broken down into twenty-four steps.

Figure 13:
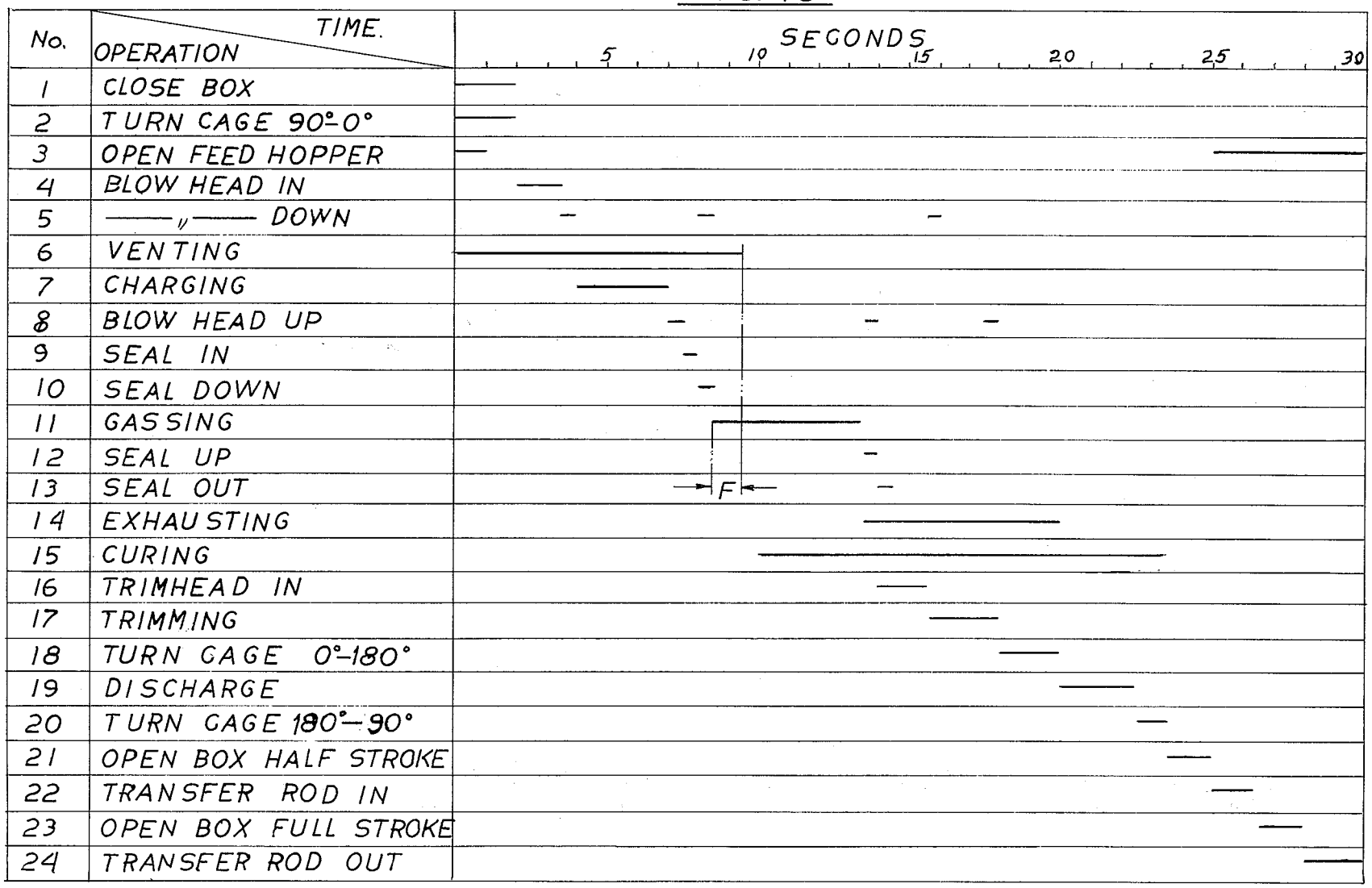
FIG. 13 is a chart showing the duration and sequence of all 24 operations of the preferred apparatus.

FIG. 13 reveals that a number of the operations are performed concurrently and the actual cycle lasts approximately only thirty seconds.

The first and second machine operations are best understood by first considering the position of the pattern box at the completion of the preceding cycle. At the completion of a cycle, the pattern box halves will be separated by a distance at least slightly larger than the width of the hollow item that has been formed. Further, the box 32 will be disposed in a transfer position, the lower port 67 will be closed, and the upper port 65 will be opened to vent (i.e., the atmosphere through a purifier but without exhaust fan). It is very desirable to end the machine cycle at this position because, once in about every 4–5 cycles, the continuous automatic cycle must be interrupted in order to clean pattern and spray their working surface with so-called release agent, a chemical liquid that helps separation of produced items from the pattern. By ending the cycle in above-described machine position, no extra machine stoppage is needed to do the cleaning and spraying of pattern (which can be done only when pattern box is open). However, had cycle ended at any other position, the extra machine stoppage and extra box opening operation for cleaning and spraying would be necessary and that would cause loss of worktime and would complicate machine controls.

Accordingly, the first and second machine operations simultaneously tightly re-close the pattern box 32 and rotate the pattern box assembly 58 approximately 90° in a counterclockwise direction. FIG. 4 shows the pattern box 32 when the first and second machine operations have been completed. These operations are preferably performed concurrently, and consume only two seconds of the machine's cycle of operations. Considered together, the first and second machine operations comprise the first step of the nine basic process steps, as shown on FIG. 4.

The pattern box 32 will now be in the correct position to receive a charge of binder-coated granular mineral into the pattern cavity 54 through investment aperture 52. The blow head means 44 must first be charged with a supply of the binder-coated granular mineral by the feed hopper 12. This is done either by vibrating the hopper, which causes material to flow through a small orifice (less than three inches) or by opening the gate at the bottom of the hopper that has large discharge orifice (larger than three inches). The charging of the blow head means 44 designated as operation No. 3 takes no extra time, as shown in FIG. 13, since it is performed concurrently with other operations.

Having received its charge of binder-coated granular mineral, the blow head means 44 is repositioned out of alignment with the feed hopper 12 and into alignment with the investment aperture 52 by the cylinder 48 that swings plate 38 to the right. This is a fourth operation on FIG. 13.

Figure 5:
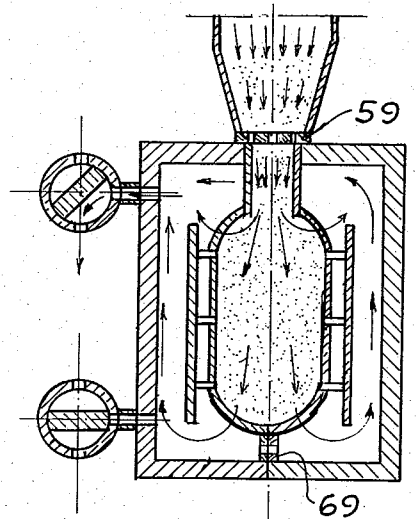
FIG. 5 depicts the second basic step.

An air cylinder 36 is then activated to urge the blow head means downwardly into tight charging relationship with the pattern cavity 54 through investment aperture 52. The vertical repositioning of the blow head means 44 comprises the fifth machine operation.

it should be noted that in the initial position of the pattern box 32, the valve 61 connects the pattern cavity with the vent so that blown air and air being in the pattern cavity 54 have an escape route when the charging operation begins. Specifically charging the pattern cavity 54 with binder-coated granular material will force the air in the cavity 54 through the permeable walls 68 and into the flow space 70. With the upper port 65 opened to venting, such air may escape from the confines of the flow space 70 thus preventing harmful back pressure. The charging, also called investing, is carried on for a period of about three seconds. The charging operation generally (operations 3 through 7) represents the second basic step of the method and is depicted in FIG. 5. The directional arrows in FIG. 5 indicate air flow.

It is important to note that blowing granular minerals by the force of compressed air results in the needed density of material to secure a firm strong product. The blow head means 54 has therefore not only charged the pattern cavity 54 with binder-coated granular mineral 54, but also has densified the material in it.

The eighth machine operation consists of displacing the blow head means 44 away from the investment aperture 52 by de-activating air cylinder 36. The bias means 50, disclosed in the detailed description of the preferred apparatus, therefore urges the blow head means 44 to vertically displace from the investment aperture 52. Such disengaging of the blow head means 44 from the investment aperture 52 takes less than a second.

The ninth machine operation which follows immediately thereafter comprises moving the seal-carrying means 96 into alignment with the investment aperture 52. The sealing means 96 is attached to the blow head by a pivot 100 and is connected to the air cylinder 102. Said sealing means carries on the bottom an elastic sealing element 104. Operation 9 provides swinging of the sealing means 96 from "out" position shown on FIG. 2 into position directly over investment aperture 52 by activating air cylinder 102.

Figure 6:
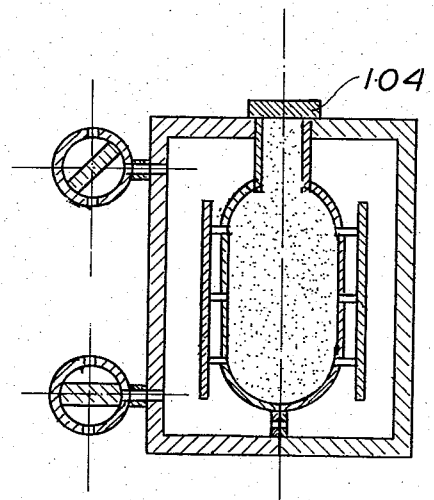
FIG. 6 depicts the third basic step.

Then, in the tenth operation, air cylinder 36 presses the blow head 44, with the sealing element under it, toward the upper surface of the pattern box 32, thus sealing investment aperture 52 tightly. This tight sealing engagement is achieved in about one second and is maintained during the next two basic steps to be disclosed hereinafter. This sealing procedure is the third basic step of the method, and is depicted in FIG. 6.

Of course the third basic method step, like the other steps, is mentioned in conjunction with specific machine operations only for ease of explanation purposes.

Figure 7:
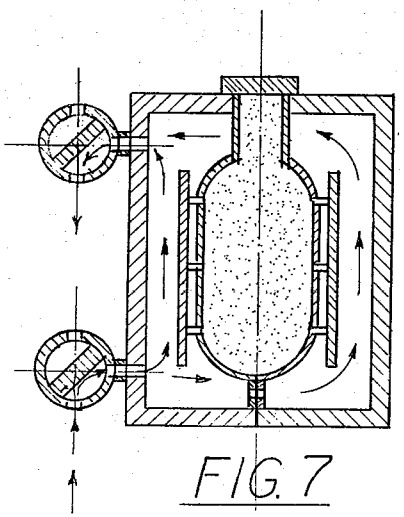
FIG. 7 depicts the fourth basic step.

The eleventh machine operation includes the introduction of catalyst gas into the flow space 70. This machine operation should be considered in conjunction with operation 6, and the combination of them represents the preferred way to perform the fourth and fifth basic method steps as is depicted in FIGS. 7 and 8, where directional arrows show the flow of catalyst gas.

At the beginning of gas introduction into flow space 70, the valve 61 remains in the position in which port 65 communicates with the vent 72, thus catalyst gas coming under 20–40 P.S.I. pressure into flow space through gas line 74 virtually flushes (replaces) air out of manifold and flow space 70 into atmosphere. This very important part of operation eleven, being the essence of the fourth basic process step depicted in FIG. 7, avoids harmful dilution of entering catalyst gas. Said dilution would lead to gas impotency, which in turn will block performance of the next vital basic process step, described hereinafter. The flushing period of the cycle is designated on FIG. 13 by the letter "F."

Figure 8:
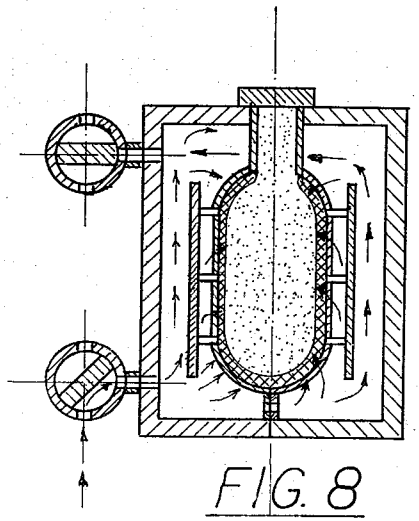
FIG. 8 depicts the fifth basic step.

As can be seen on FIG. 8, the next step of the production method begins when valve 61 closes port 65, separating flow space 70 from the vent approximately one second after the introduction of catalyst gas has begun. Now, continued delivery of compressed gas into flow space, while vent 72 is closed, causes gas to change its flow direction toward area of lower resistance, namely, into the pores of permeable pattern and into the spaces between granules of material. Said spaces of course are filled with the air at atmospheric pressure, which is lower than the pressure of catalyst gas.

Figure 9:
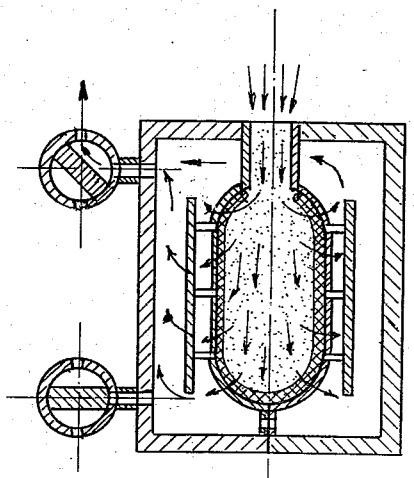
FIG. 9 depicts the sixth basic step.

The gas, surrounding pattern, presses on the air inside, until the pressures of gas and air are equalized, as described in more detail in inventor's U.S. Pat. No. 4,232,726. This process step is depicted in FIG. 8. The gassing of granular material inside of pattern cavity 54 lasts 3–4 seconds, as shown in FIG. 13, during which the polymerization of binder commences and continues as the next (fifteenth) operation, designated as "curing." It continues for about ten seconds after gassing has been terminated by closing port 67 with corresponding positioning of valve 63. Simultaneously with the closing of port 67, operations twelve and thirteen occur simultaneously. Seal means 96 is lifted away from the pattern box 32 by deactivating cylinder 36, and the cylinder 102 swings seal element 104 aside, back to the original position indicated on FIG. 2. Concurrently with the twelfth operation, the fourteenth machine operation is initiated. During this operation, residual gas is exhausted out of the material in the pattern cavity 54 and out of flow space 70. This operation is originated by positioning valve 61 in communicating relationship between port 65 and with the exhaust line 71. This causes fresh air to stream through the investment aperture 52, the material in cavity 54, permeable pattern 68, flow space 70, purifying device and the exhaust fan (not shown), to the atmosphere, as indicated by arrows on FIG. 9.

Because of many variables in the material, pressures and temperatures, it is possible that a small quantity of the binder coated granular mineral adjacent to the lowermost portion of investment aperture 52 might be occasionally hardened by the catalyst gas which would hamper discharge of unhardened material out of the hardened outer layer.

Figure 11:
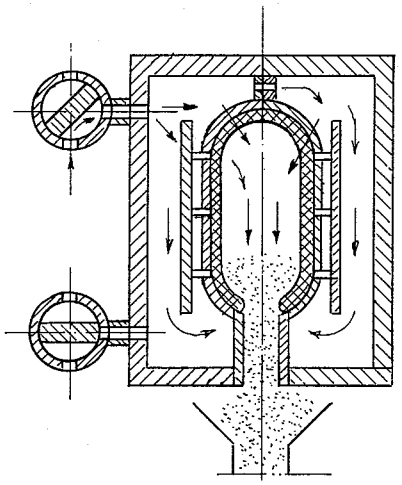
FIG. 11 depicts the eight basic step.
Figure 10:
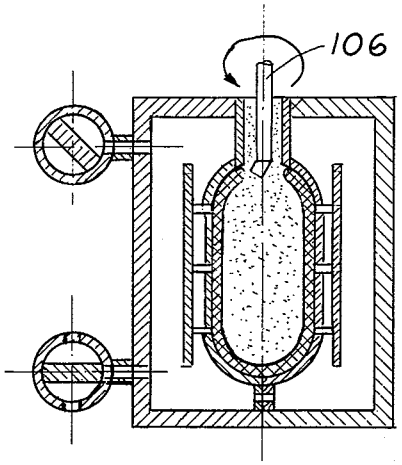
FIG. 10 depicts the seventh basic step.

Thus, during the curing (as shown in FIG. 13), the trimming head 46 must be used to trim the unwanted hardened granular mineral possibly located within investment aperture and/or under it. To accomplish the trimming, the lower plate 38 is moved by cylinder 48 to the position of alignment of trimming head 46 with the investment aperture 52. This operation is designated on FIG. 13 as the sixteenth operation of the apparatus. Upon its completion, the seventeenth operation takes place: the knife 106 is rotated by the actuator (not shown) located inside trimming head 46 and the cylinder 36 forces trimming head against spring 50 down, bringing the knife 106 inside the investment aperture. Thus, free passage of unhardened material out of hardened shell is secured. The trimming process step is depicted on FIG. 10. Upon completion of trimming, cylinder 36 is deactivated, spring 50 pushes trimming head up and operation 18 takes place: the cage assembly 58 is turned by the cylinder 108, 180°, into a discharge position, as shown on FIG. 11. This operation is designated on FIG. 13 as the eighteenth operation. To facilitate and expedite the discharge of unhardened material out of hardened shell 109, the operation 18 is immediately followed by the positioning of valve 63 to open port 67 to the compressed air supply line 73, so that air under pressure streams through permeable pattern 68 and pushes loose material granules toward lower pressure, i.e., toward investment aperture which is opened to atmosphere. This operation is designated on FIG. 13 as No. 19. The twentieth operation is to turn cage assembly 58 into transfer position, when investment aperture will be in one horizontal plane with the cage axis 80 and the transfer rod 75. Up to this moment, the fifteenth operation continued parallel to all subsequent operations and hardened shell 109 has not been handled or touched in any way, because its strength has not yet reached necessary magnitude. However, 12–14 seconds after curing started, the polimerized binder becomes strong enough to withstand mechanical handling and therefore operation 21 commences.

This operation includes opening the movable pattern box 32B a distance at least slightly greater than one-half (½) the width dimension of the formed hollow item 109. When pattern box half 32B starts its movement away from half 32A, the ejection plate 111 is not any more pressed by box half 32B, the springs 79 expand and under its force the ejection pins 78 eject the product 109 out of box half 32A and the product is now carried by movable box half 32B alone. After completion of the twenty-first operation, the centerline of investment aperture 52 coincides with the longitudinal axis of the transfer rod 75.

The insertion of the transfer rod 75 through the investment aperture 52 and the relatively narrow neck of the hollow item 109 accomplishes the twenty-second machine operation.

Figure 12:
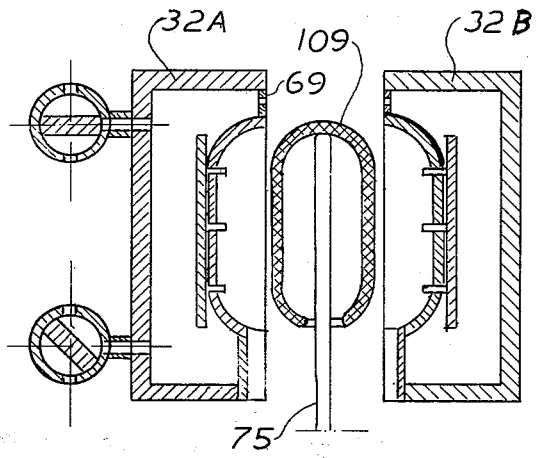
FIG. 12 depicts the ninth basic step.

Having thus supportingly engaged the item 109 with the transfer rod 75, the movable half 32B of the pattern box 32 is opened another half stroke, and such second half stroke is the twenty-third operation of the machine and the ninth last step of basic method depicted on FIG. 12. This second displacement of the movable half 32B is also at least slightly greater than one-half (½) of the width dimension of the hollow item 109. It should be noted, that the ejection plate 112 can slide on rods 114 and the distance between these rods measured in horizontal plane is greater than the width of the pattern, so that the rods 114 can protrude into flow space 70 without touching the pattern 68.

At the very beginning of the second displacement of movable pattern box half 32B, the rods 114 come in contact with the plate 115 and this causes the ejection plate 112 to move toward pattern 68 under force of springs 120 and ejection pins 78 eject product 109 out of the pattern box half 32B. Then, ejection plate comes to halt by a mechanical stop (not shown) and, while pattern box half 32B continues its stroke, the rods 114 slide relative ejection plate 112 and compress springs 118. This completes the ninth basic process step, as depicted on FIG. 12. (FIG. 12 is a plan view of related parts of the apparatus, while other schematics on FIGS. 4 through 12 are, of course, elevation views of respective parts)

Now the product 109 rests exclusively on the transfer rod 75 and withdrawal of this rod, in order to transfer the product 109 to the suitable collection place (for instance, a conveyor belt 76), signifies completion of both the last twenty-fourth operation mentioned on FIG. 13, and the completion of the cycle, as well as the rediness of inventive apparatus to commence a new cycle of operations. The cyclograme on FIG. 13 indicates that the duration of a full cycle lasts about 30 seconds, which, on the average, is four times more productive than the existing thermal process. As the foregoing description shows, the entire cycle is completely mechanized, thus making possible full automation of the manufacturing process at will.

It will thus be seen that the objects set forth above, and those made apparent from the preceding description, are efficiently attained and since certain changes may be made in the above construction and process without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, I claim:

1. An apparatus for heatless production of hollow items, such as foundry shell cores, from binder coated granular minerals, comprising:

(a) A separable-part pattern box assembly having an investment aperature in the upper end rotatingly mounted on a support frame, and selectively positionable in a material receiving position, a material discharging position, and an item transfer position;

(b) Granular material supply means pivotally disposed above the pattern box assembly and adapted to reciprocate in horizontal and vertical planes;

(c) Granular material storage means, pivotally connected above said material supply means and having freedom of movement at least in horizontal plane;

(d) Sealing means pivotally mounted on said granular material supply means, having an actuator and an elastic element selectively positionable over the investment aperture of pattern box and away from it;

(e) Trimming means with a cutting element pivotally mounted over the pattern box, and adapted to reciprocate in both horizontal and vertical planes;

(f) Mechanical elevator system for conveying solvent containing unhardened material discharged from underneath the pattern box to the material supply means above said box, and;

(g) Transfer means adapted for engaging produced item by contacting internal surfaces of the cavity and of the investment aperture of said item upon separation of the parts of said pattern box assembly in the item transfer position.

2. The apparatus of claim 1, wherein pattern box is selectively communicating with at least two manifolds, one for sequential supply of catalyst gas and compressed air and another one connected with the vent and exhaust.

3. The apparatus of claim 1 including a pattern made from a solid wear-resistant material having inserts of permeable material, said inserts disposed in staggering, chess-board-like fashion, with distance between inserts equal or less than insert diameter.

4. The apparatus of claim 1, wherein said pattern box has at least two ports for input and output of fluids.

5. The apparatus of claim 1, wherein said sealing means actuator is pivotally connected to said material supply means.

6. The apparatus of claim 1, wherein means are provided for opening the parts of said pattern box slightly greater than the width of produced item.

7. The apparatus of claim 1, including means for separating said pattern box parts with a first and a second stroke, and wherein said transfer means is adapted to engage a produced item after first stroke of movable pattern box half and before commencement of the second stroke.

8. The apparatus of claim 7, including ejection means wherein ejection of produced item out of stationary pattern box half is done at the beginning of first opening stroke and the ejection of said item out of the movable pattern box half is done at the beginning of the second opening stroke.

9. The apparatus of claim 1, wherein the trimming means has a cutting element slightly exceeding the length of the investment aperture of the pattern box.

10. The apparatus of claim 9, wherein cutting element is adapted to rotate around longitudinal axis of the trimming means, being disposed away from said axis at a distance slightly less than the radius of investment aperture.

11. The apparatus of claim 9, wherein reciprocal motion of the cutting element exceeds the length of the investment aperture plus the expected thickness of the wall of the item to be produced.

12. The apparatus of claim 9, wherein said trimming means is adapted to be selectively placed in at least two positions, one of which corresponds to alignment of cutting element with the investment aperture, and another having cutting element completely out of space above the pattern box.

13. The apparatus of claim 1, wherein all mechanisms and machine parts located directly above the pattern box, are pivotaly mounted on the support frame whereas said pivot is at a distance from the said pattern box sufficient to swing said mechanisms and parts out of the space disposed directly above said pattern box.

14. The apparatus of claim 1, wherein fluids to and from said flow space are adapted to be conducted through a hollow shaft of the said pattern box assembly.

15. The apparatus of claim 1, wherein the investment aperture in the pattern box has minimum diameter of about 3 inches, required for the flow of unhardened sand out of the pattern box.

16. The apparatus of claim 1, including a blow plate at the bottom of said material supply means with a number of orifices, each not more than approximately $\frac{3}{4}$ inch diameter which is small enough to prevent arbitrary flow of the binder coated granular material out of material supply means, but large enough to permit said material to flow freely into the investment aperture under the pressure of compressed air.

17. The apparatus of claim 16, wherein said orifices in the said blow plate are disposed within a circle diameter which is slightly less than the diameter of said investment aperture.

18. A method for heatless production of hollow items, such as foundry shell cores, from binder coated granular minerals, comprising:

(a) Readying pattern box assembly for charge of binder coated granular mineral material, said pattern box assembly having an investment aperture, a flow space, a gas manifold, and a vent;

(b) Densifyingly charging said material into said pattern box assembly through said investment aperture; then (c) Sealing said investment aperture; then (d) Flushing air out of said flow space and the gas manifold by introducing catalyst gas into said pattern box while maintaining the vent in the open disposition for approximately one (1) second; then (e) Forcing catalyst gas to penetrate to certain depth into said material by closing vent, thus separating said pattern cavity from the atmosphere; then (f) Terminating the admittance of catalyst gas into said flow space and commencing the curing of catalyzed material layer, while unsealing said investment aperture and opening said flow space to the exhuast;

(g) Trimming potential excess hardened material from the said investment aperture;

(h) Discharging the unhardened material from said pattern box and returning it back to said material supply means; and (i) Opening said pattern box and removing produced hollow item.

19. Method of claim 18, wherein the flushing of the air from said flow space is achieved by opening communication between said flow space and the vent prior to and about one (1) second after the commencement of catalyst gas introduction into said flow space of the said pattern box.

20. Method of claim 18, wherein air blow into said pattern box during said material charge operation escapes out through said permeable pattern and the vent.

21. Method of claim 18 wherein:

Operation "a" includes closing said pattern box assembly, turning said pattern box assembly to the initial charging position at 0° with said investment aperature facing toward a blow head, generally designated as material supply means, replenishment of material in the blow head, which commenced at the end of a previous cycle, opening said vent, establishing communicating relationship between said flow space and the atmosphere, moving said blow head from a replenishment position to a position over the said pattern box, and pressing said blow head to the said pattern box creating direct communicating relationship between blow plate orifices and said inventment aperature in said pattern box;

Operation "b" includes charging material from said blow head into said pattern box by means of compressed air, and lifting said blow head away from said pattern box;

Operation "c" includes moving a sealing element from side position to down position between said blow plate and said investment aperture, and moving said blow head down pressing said sealing element to said pattern box over said investment aperature;

Operation "d" includes introducing catalyst gas into said flow space and closing said vent about one (1) second later, thus flushing air out of said flow space while continuing gassing for another 2–3 seconds, thus forcing said gas into the pattern cavity which starts polymerization and curing of the binder;

Operation "f" includes lifting said blow head with said seal means up, swinging said seal element aside, and starting exhaust concurrently with said lifting;

Operation "g" includes positioning a trimming head with a cutting element over said investment aperature, and pressing said trimming head down while rotating said cutting element, thus trimming excess hardened material out from said investment aperature;

Operation "h" includes turning said pattern box assembly 180° to a discharging position directing said investment aperature down and stopping exhaust, introducing compressed air into said flow space, thus dislodging unhardened material out from the inside of the hardened shell, and turning said pattern box assembly back from said discharging position to an item transfer position;

Operation "i" includes opening said pattern box with a first stroke, simultaneously ejecting the item from the stationary pattern box half, engaging the item with transfer means, opening the pattern box with a second stroke, simultaneously ejecting the item from the movable pattern box half, and withdrawing said transfer means with the item from the pattern box area to a desirable place of collection.

* * * * *